US007920822B2

(12) United States Patent
Chu et al.

(10) Patent No.: US 7,920,822 B2
(45) Date of Patent: Apr. 5, 2011

(54) DEVICE FOR PREVENTING EAVESDROPPING THROUGH SPEAKER

(75) Inventors: Kwang Uk Chu, Seoul (KR); In Ho Hwang, Daejeon (KR); Jong Kyu Kim, Daejeon (KR); Sang Woo Cho, Daejeon (KR); Dae Heon Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 485 days.

(21) Appl. No.: 12/056,670

(22) Filed: Mar. 27, 2008

(65) Prior Publication Data

US 2009/0093211 A1 Apr. 9, 2009

(30) Foreign Application Priority Data

Oct. 8, 2007 (KR) ..... 10-2007-0100838

(51) Int. Cl.
*H04K 3/00* (2006.01)

(52) U.S. Cl. ..... 455/1; 455/67.11; 455/63.1; 455/67.13

(58) Field of Classification Search ..... 455/1, 67.11, 455/63.1, 67.13, 69; 379/184, 247
See application file for complete search history.

(56) References Cited

U.S. PATENT DOCUMENTS

| | | | | |
|---|---|---|---|---|
| 3,725,595 | A * | 4/1973 | Mechanic-Esfahani | 379/184 |
| 4,744,103 | A * | 5/1988 | Dahlquist et al. | 379/247 |
| 5,961,646 | A * | 10/1999 | Sokol | 726/15 |

FOREIGN PATENT DOCUMENTS

| | | | |
|---|---|---|---|
| KR | 2020000015270 | U | 7/2000 |
| KR | 1020030079638 | A | 10/2003 |
| KR | 10-0643310 | B1 | 10/2006 |
| KR | 1020080065327 | A | 7/2008 |
| WO | 03/009499 | | 1/2003 |

* cited by examiner

*Primary Examiner* — John Lee
(74) *Attorney, Agent, or Firm* — Ladas & Parry LLP

(57) ABSTRACT

Provided is a device for preventing eavesdropping through a speaker. More particularly, a device for preventing eavesdropping by transmitting a jamming signal through a speaker common signal line is provided, the device including: a jamming signal generator for generating a jamming signal comprising a noise signal; an amplifier for amplifying the jamming signal; and a transformer for receiving the amplified jamming signal from the amplifier and outputting the amplified jamming signal to a speaker common signal line. The device may transmit a jamming signal in an audible frequency band to the speaker common signal line, thereby rendering conversations unrecognizable to eavesdroppers when an electrical signal induced from a speaker is detected through the speaker common signal line.

9 Claims, 3 Drawing Sheets

DEVICE FOR PREVENTING EAVESDROPPING THROUGH SPEAKER

CROSS-REFERENCE TO RELATED APPLICATION

This application claims priority to and the benefit of Korean Patent Application No. 2007-100838, filed Oct. 8, 2007, the disclosure of which is incorporated herein by reference in its entirety.

BACKGROUND

1. Field of the Invention

The present invention relates to a device for preventing eavesdropping through a speaker, and more particularly, to a device for preventing eavesdropping, which transmits a jamming signal through a speaker common signal line.

2. Discussion of Related Art

The development of electronic devices has provided society with added convenience, but has also led to growing problems such as leakage of private information. Today, invasion of privacy and violation of individuals' rights by means of various types of electronic devices have become serious social problems.

For example, a speaker is generally used to output sound, but it can sometimes be operated as a microphone and misused as a means for eavesdropping.

FIGS. 1A and 1B are schematic diagrams illustrating structures of a speaker and a microphone.

Referring to FIG. 1A, a speaker includes a coil 102 surrounding a permanent magnet 101 and speaker cone 103 attached to the coil, which generates sound due to vibration of the speaker cone 103 caused by an electromagnetic force in accordance to the Lorentz force law when an output current of an electrical signal generator 104 flows through the coil 102.

Referring to FIG. 1B, a microphone, which is the same as the speaker, includes a coil 106 surrounding a permanent magnet 105 and speaker cone 107 attached to the coil. However, unlike the speaker, the microphone can receive sound information at an electrical signal receiver 108 by applying a current through the coil 106 due to electromagnetic induction when the speaker cone 107 is vibrated by external sound.

As described above, since the speaker and microphone are basically formed with the same structure, a current can also be induced to a coil in the speaker by external sound like in the microphone. Moreover, in the case of a speaker used for broadcasting in a building, a plurality of which are installed on the ceilings and walls of rooms while connected with a common signal, an electrical signal induced from the speaker is transmitted through a speaker common signal line. An eavesdropper is then able to receive the induced electrical signal through a speaker common signal line, thereby eavesdropping on any conversations made in the room where the speaker has been installed.

SUMMARY OF THE INVENTION

The present invention is directed to providing a device for preventing eavesdropping that can occur when an electrical signal induced from a speaker is received through a speaker common signal line.

One aspect of the present invention provides a device for preventing eavesdropping through a speaker, which includes: a jamming signal generator for generating a jamming signal comprising a noise signal; an amplifier for amplifying the jamming signal; and a transformer for receiving the amplified jamming signal from the amplifier and outputting the amplified jamming signal to a speaker common signal line.

BRIEF DESCRIPTION OF THE DRAWINGS

The above and other objects, features and advantages of the present invention will become more apparent to those of ordinary skill in the art by describing in detail exemplary embodiments thereof with reference to the attached drawings in which.

DETAILED DESCRIPTION OF EXEMPLARY EMBODIMENTS

The foregoing and other objects, features and advantages of the invention will be apparent from the following more particular description of exemplary embodiments of the invention, as illustrated in the accompanying drawings.

Figure 1A:
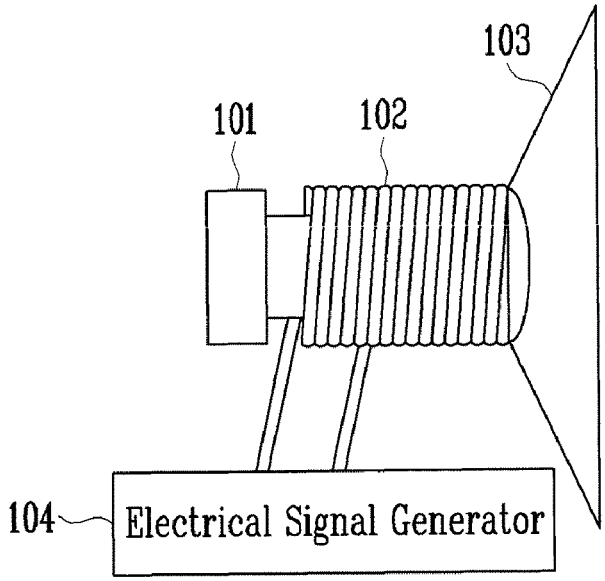
FIGS. 1A and 1B are schematic diagrams illustrating structures of a speaker and a microphone.
Figure 1B:
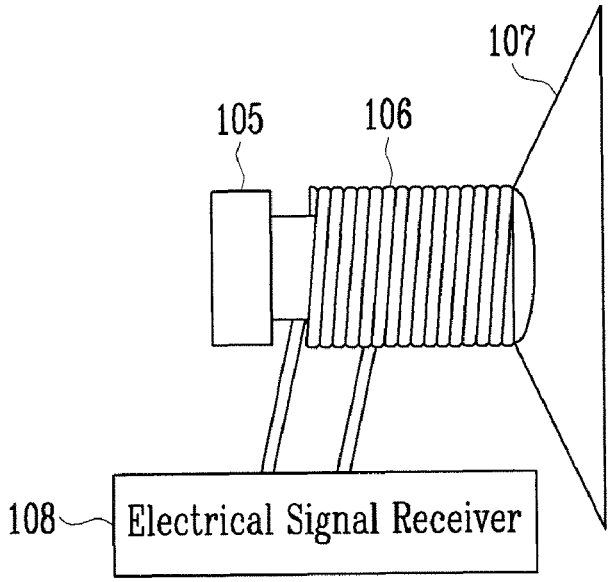
Figure 2:
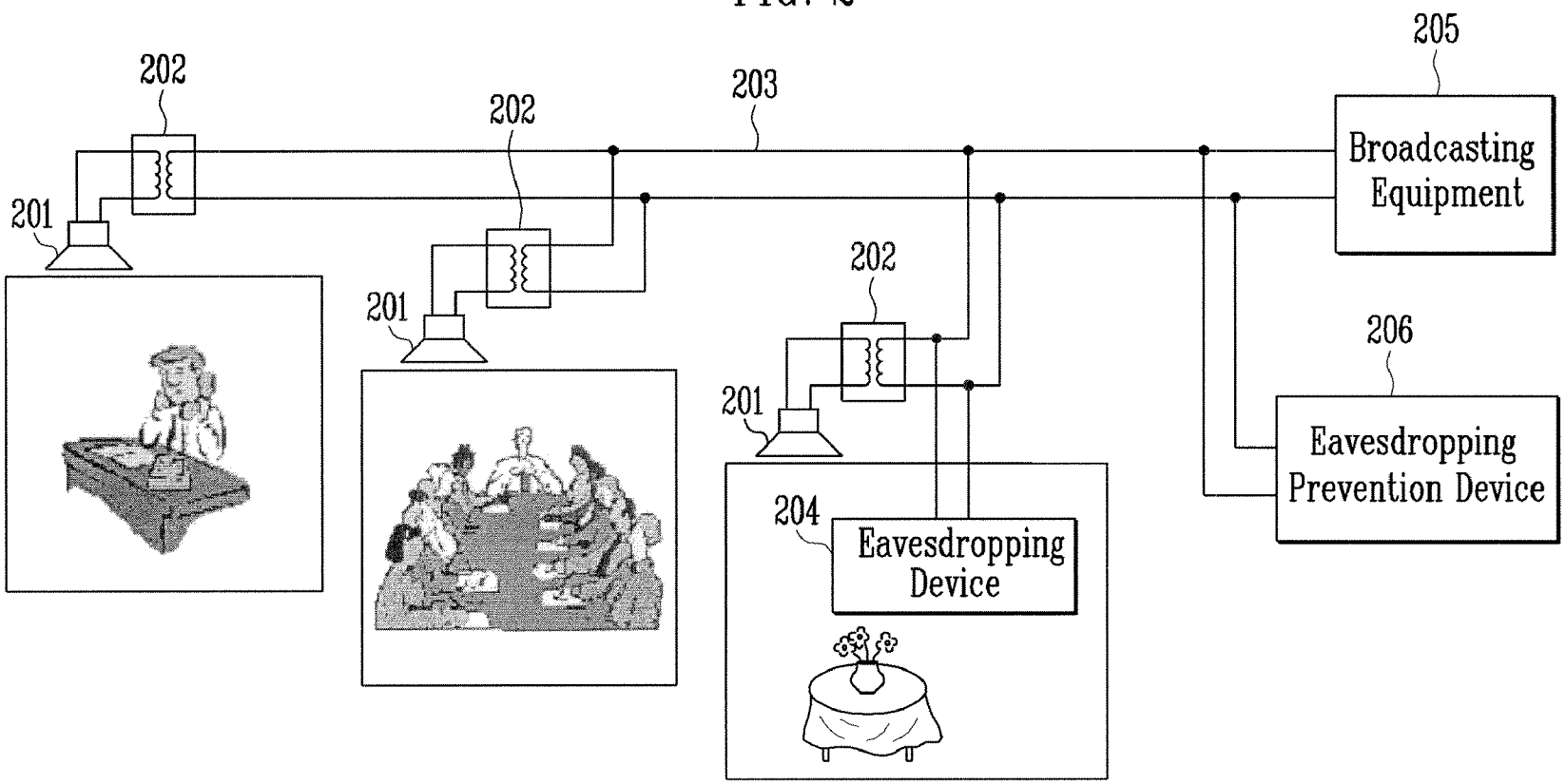
FIG. 2 is a diagram illustrating an environment where a device for preventing eavesdropping is operated according to an exemplary embodiment of the present invention.

FIG. 2 is a diagram illustrating an environment where a device for preventing eavesdropping is operated according to an exemplary embodiment of the present invention.

Referring to FIG. 2, generally, a broadcasting speaker 201 is installed on a ceiling or wall of a room while connected in parallel to a speaker common signal line 203. Broadcasting equipment 205 may transmit equal broadcasting signals to the broadcasting speakers 201 through the speaker common signal line 203. Each broadcasting speaker 201 receives the broadcasting signal from the speaker common signal line 203 by a transformer 202 for matching impedance to receive a high-voltage signal.

Using such a structure, an eavesdropper may listen to a conversation made in another room by connecting an eavesdropping device 204 to the speaker common signal line 203 at a place easily accessible, for example, a lounge, to collect electrical signals induced from the broadcasting speaker 201 installed in the room, filtering out a signal in an audio frequency band from the collected electrical signals, and converting the filtered signal into sound.

To prevent such eavesdropping using a speaker common signal line, an eavesdropping prevention device 206 according to an exemplary embodiment of the present invention may prevent eavesdropping using a masking effect by outputting a jamming signal to interrupt eavesdropping through the speaker common signal line 203.

Here, the masking effect is a phenomenon using a human's natural hearing ability, that is, when sound A and sound B, which is a predetermined level higher than sound A, are made simultaneously, a human is only able to recognize sound B and not sound A. Here, it can be expressed that sound B masks sound A, thus called the "masking effect."

Consequently, the eavesdropping prevention device 206 may output a jamming signal in an audible frequency band, which has a higher level of sound than the conversation being listened to, to the speaker common signal line 203. In doing so, an eavesdropper may not be able to hear the conversation due to the masking effect even when picking up a speech signal in an audible frequency band from the electrical signals induced to the speaker common signal line 203.

Figure 3:
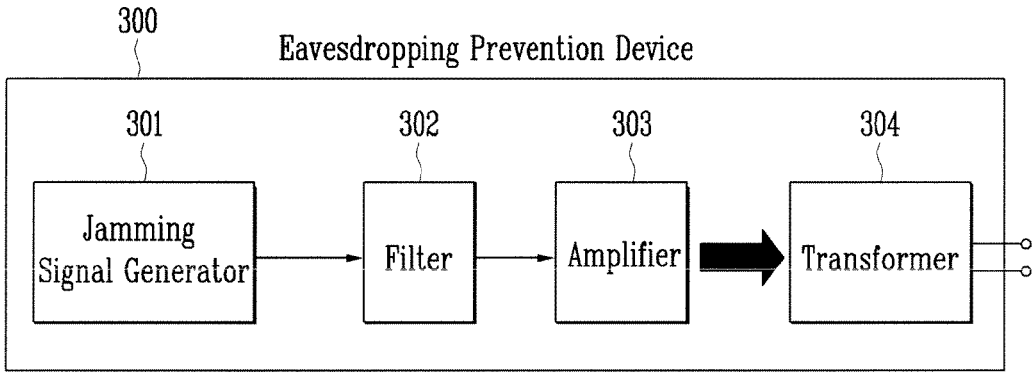
FIG. 3 is a block diagram of the configuration of a device for preventing eavesdropping according to an exemplary embodiment of the present invention.

FIG. 3 is a block diagram of the configuration of a device for preventing eavesdropping according to an exemplary embodiment of the present invention.

Referring to FIG. 3, an eavesdropping prevention device 300 includes a jamming signal generator 301, a filter 302, an amplifier 303 and a transformer 304.

The jamming signal generator 301 generates a jamming signal having characteristics of a noise signal, to interrupt eavesdropping through a speaker. In one embodiment, the jamming signal generator 301 may be implemented using a bipolar junction transistor including an open collector or a digital processor, and the jamming signal may be a white noise signal.

The filter 302 receives the jamming signal from the jamming signal generator 301 and filters the signal into an audible frequency band. In one embodiment, the filter 302 may be a band-pass filter for filtering out a signal in an audible frequency band ranging from 20 Hz to 20 kHz. In another embodiment, the filter 302 may be a low-pass filter, which reduces the level of an input signal to about 10 dB/oct (preferably, 9 to 11 dB/oct) as the input signal approaches a higher band for making the spectrum of the jamming signal similar to a spectrum of human voice.

The amplifier 303 amplifies the jamming signal generated from the jamming signal generator 301. Here, the amplifier 303 amplifies the jamming signal to a higher level than the electrical signal induced through the speaker, and thus an eavesdropper may not recognize contents of conversation due to the masking effect. In one embodiment, when the level of the electrical signal induced to the speaker by speech of someone taking part in the conversation is 10 $mV_{peak\text{-}to\text{-}peak}$, and the level of the jamming signal is 1 $mV_{peak\text{-}to\text{-}peak}$, the amplifier 303 may amplify the jamming signal by 100 to 1000 times, thereby preventing eavesdropping due to the masking effect.

The amplified jamming signal is output to a speaker common signal line through the transformer 304. In one embodiment, the transformer 304 may have the same configuration as a transformer for matching impedance of speakers connected to a speaker common signal line.

The present invention may output a jamming signal in an audible frequency band to a speaker common line to prevent the recognition of conversations subject to eavesdropping even when an electrical signal induced from a speaker is received through the speaker common signal line.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A device for preventing eavesdropping through a speaker, comprising:

a jamming signal generator for generating a jamming signal comprising a noise signal;

an amplifier for amplifying the jamming signal;

a low-pass filter for filtering the jamming signal into an audible frequency band in which the filter filters the jamming signal to decrease the level of sound by a predetermined ratio as the signal approaches a higher band; and a transformer for receiving the amplified jamming signal from the amplifier and outputting the amplified jamming signal to a speaker common signal line.

2. The device according to claim 1, wherein the amplifier receives and amplifies the jamming signal filtered through the filter.

3. The device according to claim 2, wherein the the amplifier is configured to amplify the jamming signal by 10 to 100 times that of an electrical signal induced in the speaker by speech of someone taking part in a conversation.

4. The method according to claim 3, wherein the predetermined ratio ranges from 9 to 11 dB/oct.

5. The device according to claim 1, wherein the jamming signal generator comprises a bipolar junction transistor having an open collector.

6. The device according to claim 1, wherein the jamming signal generator comprises a digital processor which generates the jamming signal.

7. The device according to claim 1, wherein the jamming signal comprise a white noise signal.

8. The device according to claim 1, wherein the audible frequency band ranges from 20 Hz to 20 kHz.

9. The device according to claim 1, wherein the transformer is formed in the same configuration as a transformer for matching impedance of the speaker connected to the speaker common signal line.

* * * * *